United States Patent [19]

Worack

[11] Patent Number: 4,695,016

[45] Date of Patent: Sep. 22, 1987

[54] SLOW MOTION ACTUATING DEVICE

[76] Inventor: Stephen A. Worack, 361 Herrick Rd., Riverside, Ill. 60546

[21] Appl. No.: 770,724

[22] Filed: Aug. 29, 1985

[51] Int. Cl.[4] ..... B61L 1/02; E01B 7/00

[52] U.S. Cl. ..... 246/415 A; 246/240; 246/326; 246/430; 318/40; 318/436

[58] Field of Search ..... 246/218, 221, 240, 242 A, 246/242 R, 242 B, 242 C, 326, 415 R, 415 A, 422, 430; 318/40, 436

[56] References Cited

U.S. PATENT DOCUMENTS

| | | | |
|---|---|---|---|
| 764,043 | 7/1904 | Coleman | 246/240 |
| 867,528 | 10/1907 | Parr | 246/221 |
| 1,573,234 | 2/1926 | Eppley | 246/240 |
| 2,870,288 | 1/1959 | Schmidt | 318/436 |
| 3,808,483 | 4/1974 | Kembuegler et al. | 318/436 |

FOREIGN PATENT DOCUMENTS

| | | | |
|---|---|---|---|
| 5236 | 12/1900 | Austria | 246/240 |

OTHER PUBLICATIONS

Reb. Industries Brochure Describing Rebco Switch Machine.

Mann-Made Products Instructions for Model No. 814 Switch Machine.

Rix Products Instructions for Rix Rax Mounting Bracket.

Rix Products Advertisement for Rix Rax Mounting Bracket.

Odegard, Gordan, "Thermal Switch Machine", *Model Railroader,* Jul. 1965, p. 30.

Odegard, Gordon, "Concealed Mounting for Sectional-Track Switch Machines", *Model Railroader,* Apr. 1964, p. 59.

Taylor, Frank, "Do It Pneumatically", *The Model Railroader,* Jun. 1942, pp. 290-293.

Thompson, Ken, "Cat Mountain Turnout Motors", *Model Railroader,* Sep. 1985, pp. 92-94.

*Primary Examiner*—Randolph A. Reese

*Assistant Examiner*—Glenn B. Foster

*Attorney, Agent, or Firm*—Kinzer, Plyer, Dorn, McEachran & Jambor

[57] ABSTRACT

A slow motion actuating device has a housing with a first opening therein through which an output pin extends. The output pin is connected to a swing arm which is pivotally mounted in the housing and driven by a set of reduction gears. Stops are provided in the housing for limiting movement of the swing arm. An electric motor is mounted in driving relation with the gear set. The motor has a stall current which is low enough to allow the motor to be continuously stalled without damaging it. A printed circuit board is mounted in the housing with a tail portion extending through a second opening in the housing. The circuit board provides electrical connections to the motor and auxiliary contacts which can be opened and closed by a wiper mounted on the swing arm.

11 Claims, 3 Drawing Figures

SLOW MOTION ACTUATING DEVICE

BACKGROUND OF THE INVENTION

This invention relates to an actuating device suitable for use as a model railroad switch machine, although it could be used in any application requiring a relatively slow throw.

Referring to the model railroad switch machine art, the standard of the industry for many years has been the so-called twin coil machine. This is a solenoid actuated device which produces a loud, instantaneous throw of the switch points. This type of device has several disadvantages. It is easy to burn out the solenoid. The movement is hard on the switch points as they are forced to absorb the impact of being slammed against their associated rails. And the instantaneous movement does not provide a prototypical action, since full-size switch points require a certain amount of time to be thrown. The fast action of a solenoid switch machine does not reproduce the slow motion action of full-sized switches. In the eyes of a serious modeler, this is a significant defect in the twin coil machines.

The problem of the fast versus slow motion action has been addressed by so-called jackscrew machines. These machines use a small electric motor driving a long screw engaging a sliding member. While these machines provide a prototypical action, they are noisy and unreliable. A flexible coupling between the screw and the motor is a common source of failure.

Another approach to a slow motion switch machine uses a reduction gear train driven by a motor having a stall current that is so low that the motor can be continuously stalled without damaging it. Previous devices of this type have applied the full torque of the motor to the switch points. That is, the motor throws the switch points up against a rail which must provide the resistance required to stall the motor. This risks damage to finely-constructed switch points. Another drawback of previous switch machines utilizing a stalled motor concept has been the difficulty of providing auxiliary contacts which are advantageously used for providing signals indicative of the switch condition.

SUMMARY OF THE INVENTION

This invention relates to slow motion actuating devices. The invention has particular application as a model railroad switch machine having a prototypical slow motion action. It will be understood, however, that the invention is not necessarily limited to use in the model railroad field.

A primary object of the invention is an actuating device for effecting a slow motion movement of a thrown device.

Another object of the invention is an actuating device of the type described having minimal interface or driver circuitry and which could be driven by integrated circuits.

Another object of the invention is an actuating device of the type described having an electric motor with low current drain.

Another object is an actuating device having an electric motor with a stall current low enough that the motor can be continuously stalled without damage, thereby eliminating the need for circuitry to remove power from the device at the end of a throw.

Yet another object of the invention is an actuating device having positive stops which relieve stress on the thrown device.

Still another object is an actuating device having a gear drive mechanism.

Another object is an actuating device providing a substantially linear throw.

A further object of the invention is an actuating device having auxiliary contacts which can be utilized to create electrical signals indicative of the condition of the device.

Another object of the invention is an actuating device having an enclosed construction.

Another object of the invention is an actuating device which is reliable and quiet.

Other objects will become apparent in the following specification and claims.

DETAILED DESCRIPTION OF THE INVENTION

Figure 1:
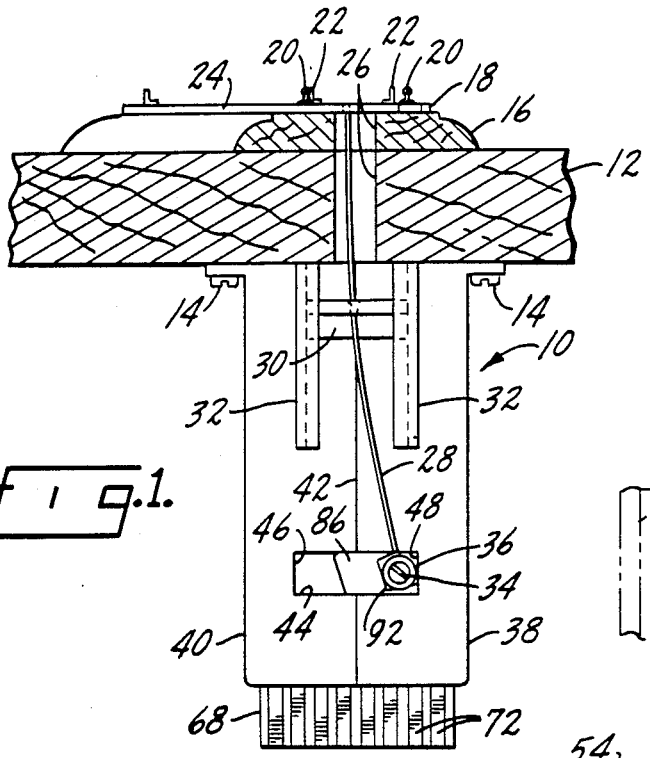
FIG. 1 is a front elevation view of the actuating device mounted for operation as a model railroad switch machine, with the railroad portions in section.

FIG. 1 shows the actuating device of the present invention mounted for use as a model railroad switch machine. The switch machine 10 is mounted on the underside of a base board 12 by screws 14 or the like. The model railroad layout is on the upper side of the board 12 and includes the rail bed 16, ties 18, rails 20, switch points 22 and a throw bar 24. Aligned openings 26 in the base board 12 and rail bed 16 permit passage of a throw rod 28. The throw rod extends into an opening in the throw bar 24 such that movements of the upper end of the throw rod are transmitted to the throw bar.

The throw rod 28 passes through a fulcrum member 30 which is adjustably positioned on the front of the switch machine. The position of the fulcrum is adjustably fixed by two angle members 32. The fulcrum member may be press-fit underneath the angle members or there could be other suitable means for retaining it in place, such as a set screw. The fulcrum surface adjacent the switch machine housing may be serrated to help retain the fulcrum in place. The lower end of the throw rod 28 engages the output pin of a swing arm and is retained by a screw 34 and washer 36. The output pin and swing arm will be described in detail below.

Looking now at the switch machine itself, the machine has a housing which is split into two generally hollow cases 38 and 40 along line 42. The front of each case has a three-sided slot, the slots being aligned to form a first opening 44. The opening includes stop means 46 and 48 at either end.

Figure 2:
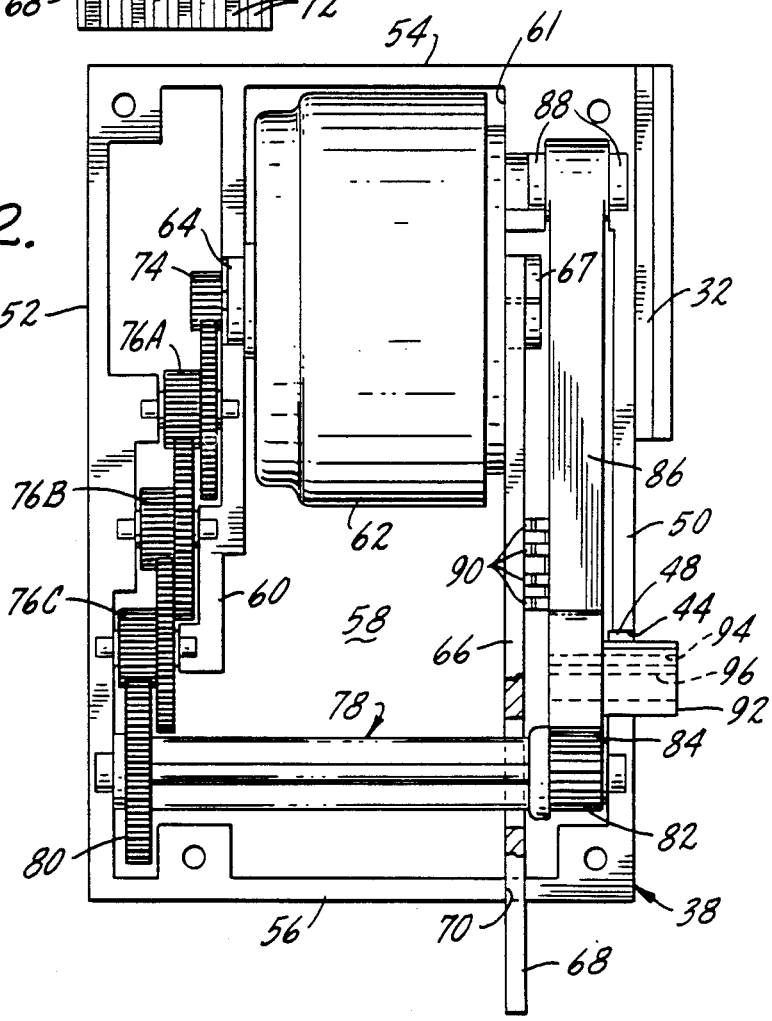
FIG. 2 is a side elevation view of the switch machine, on an enlarged scale, with one of the housing cases removed to show the internal structure of the device.

FIG. 2 shows the interior of the case 38 and the internal components of the switch machine. The case has a front wall 50, a back wall 52, a top wall 54, a bottom wall 56 and a side wall 58. An interior wall 60 extends along the side wall 58 and has a stepped configuration. There is also a shoulder 61 formed at the intersection between the front wall 50 and side wall 58. The mating case 40 is similarly constructed, substantially in mirror image so the two cases put together form a hollow enclosure.

An electric motor 62 is located in the upper central portion of the housing. The motor has a boss 64 which fits in a socket in the interior wall 60. The other side of the motor engages the shoulder 61 to hold the motor in place.

A printed circuit board 66 is soldered to the lugs of the motor and rests along the side wall 58. A second motor boss 67 fits in an opening in the printed circuit board. A tail portion 68 of the printed circuit board extends through a second opening 70 in the bottom wall 56. This provides a convenient connection point for circuit means 72 (FIG. 1) which provide electrical connections and auxiliary switch contacts.

The motor 62 is a three-pole, permanent magnet motor having pairs of poles wired in series. The motor has a very low current drain. The no load current is 2 mA with a speed of 2400 rpm. At a rated load of 0.5 g-cm, the current is 3.5 mA, with a speed of 2150 rpm, all ratings at 12 VDC. The terminal resistance is approximately 700 ohms which results in a current draw of about 14 mA at stall. Thus, the power dissipated at stall is only about 168 milliwatts. With such a low stall current and accompanying power dissipation at stall, there is no significant temperature rise in the motor, and thus, the motor will not be damaged even if continuously stalled. The motor has no opening or closing contacts, allowing a much simplified wiring. Further, no interface circuitry is needed to handle the high current draw of more traditional motors. It would be possible, although not required, to drive the motor directly by integrated circuits.

The output shaft of the motor drives a pinion 74 which engages a set of reduction gears. The set of reduction gears comprises three separate gears 76A, B, C. Each of the gears is an integral member having a large gear and a pinion mounted on an integral shaft. The pinions and gears mesh together as shown in FIG. 2. Preferably, these are simple spur gears. The gear shafts rest in bearing sockets formed in the interior wall 60 and the back wall 52. Each casing piece has a half of the bearing socket formed therein so that the gears can be placed in one casing and then trapped therein when the other casing half is enclosed about the gear shafts.

The set of reduction gears further includes a stem gear 78 which has a long shaft terminating with stub-shafts. These are mounted in sockets formed in the back wall 52 and front wall 50. The stem gear 78 includes a large gear 80 meshing with the last pinion gear 76C. The shaft of the stem gear passes through an opening in the printed circuit board 66. The front end of the stem gear carries a pinion 82.

Figure 3:
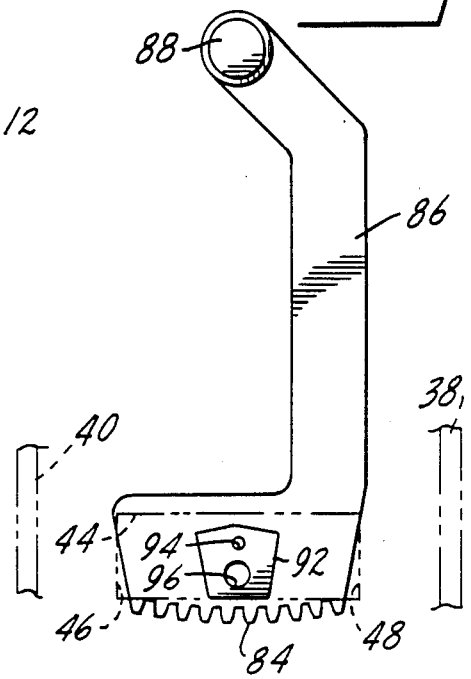
FIG. 3 is a front elevation view of a swing arm, with portions of the housing shown in phantom.

The stem gear pinion 82 engages a segment gear 84 which is formed on the bottom of a swing arm 86 (FIGS. 2 and 3). The end of the swing arm opposite the segment gear 84 has integral stub shafts 88 mounted in bearing sockets in the shoulder 61. Thus, the swing arm is pivotally mounted in the housing. The swing arm may carry a plurality of wiper fingers 90 for engaging circuitry 72 on the front face of the printed circuit board. These auxiliary contacts may, for example, provide two sets of single-pole, double-throw switches. In a model railroad application these might be used to provide power routing to the turnout frog and panel lamps, or to operate semaphore signals, crossing gates, block signals and the like.

The front of the swing arm 86 carries the output pin 92 which, as explained above, extends through the first opening 44. The output pin 92 has a small hole 94 which receives a 90° bend in the end of the throw rod 28. The throw rod is held in the hole 94 by the washer 36 which is in turn held in place by the screw 34. The screw fits in a bore 96 in the output pin.

The gears and swing arm are preferably made of acetyl plastic such as Dupont Delrin and the housing is made of high impact styrene. The throw rod is music wire. Also, for reference purposes only, the segment gear 84 has a pitch diameter of about 3.75 inches, centered on the axis of shaft 88.

The use, operation and function of the invention are as follows:

Upon the initial installation and set up of the switch machine, the throw rod 28 is threaded through the fulcrum 30 and openings 26 and is inserted in the holes in the output pin and throw bar to connect the output pin 92 to the throw bar 24. The position of the fulcrum 30 is adjusted to provide the desired amount of throw and tension on the switch points. This adjustment allows the switch machine to be used on different gauges of model railroad track. When power is initially applied to the switch machine, the switch points will assume either the straight through or turnout position.

To throw the switch points, the polarity of the electrical connections to the motor 62 is reversed which will cause the motor pinion 74 to turn. This rotates the reduction gears 76 and the stem gear 80 and its pinion 82. Engagement of the segment gear 84 with the pinion 82 pivots the swing arm 86 about its shaft 88. As the swing arm pivots, the output pin 92 carries the throw rod 28 which in turn shifts the throw bar 24 toward the opposite condition. The motor 62 continues to rotate until the output pin 92 contacts one of the stops 46 or 48. When the pin contacts one of the stops, the reduction gears are held fixed and the motor stalls. Due to the low stall current of the motor, it will not be damaged even though no mechanism is provided for disconnecting the power supply. The motor remains in a stalled condition until the polarity is again reversed and the switch is thrown back to its original condition, where the pin will contact the original stop. The motor will again be stalled and remain in that stalled condition. For reference purposes only, the switch machine takes about three seconds to complete a throw.

It will be noted that due to the output pin 92 contacting the stop means 46 and 48, the full torque of the motor and drive train is never applied to the switch points. Thus, the stop means provide a stress relief so that only whatever tension is desired from the throw rod is applied to the switch points. This eliminates the possibility of damaging the switch points by direct application of the motor torque to the points.

The swing arm is designed to have a relatively long radius. It will be noted that the arm is pivotally mounted near the top of the housing, while the output pin is fairly close to the bottom of the housing. The effect of this is that the arcuate swing of the output pin is relatively small compared to its side-to-side motion. This provides a substantially linear output. By "substantially", it is meant that the vertical component of movement is small compared to the horizontal component of movement.

While the actuating device has been shown and described in connection with model railroad switches, it will be understood that the invention is not limited to this application. It could be used in any application where a slow motion throw is desired.

Whereas a preferred form of the invention has been shown and described, it will realized that modifications may be made thereto without departing from the scope of the following claims.

I claim:

1. A switch machine for effecting a prototypical throw of model railroad switch points, comprising:

a housing having a first opening therein;

an electric motor mounted in the housing, the motor having a stall current low enough to allow the motor to be continuously stalled without damage to the motor;

circuit means providing electrical connections to the motor;

a set of reduction gears mounted in the housing and driven by the motor;

a swing arm pivotally mounted in the housing, driven by the reduction gears, and engageable with the switch points through the first opening; and stop means in the housing, engageable with the swing arm, limiting movement of the swing arm to a point where the switch points are fully thrown but the torque of the motor is absorbed by the stop means and not by the switch points.

2. The switch machine of claim 1 further comprising an output pin attached to the swing arm and extending through the first opening, the stop means comprising a pair of walls at either end of the opening, engageable with the output pin to stop movement of the swing arm.

3. The switch machine of claim 1 wherein the swing arm has a segment gear engaging one of the reduction gears.

4. The switch machine of claim 1 wherein the swing arm is pivotally mounted at one end and has an output pin at the other end, extending through the first opening.

5. The switch machine of claim 1 wherein the swing arm has a length such that the motion of the output pin is substantially linear.

6. The switch machine of claim 1 wherein the circuit means comprises a printed circuit board mounted in the housing.

7. The switch machine of claim 6 wherein the printed circuit board has auxiliary switch leads formed thereon and the swing arm carries a contact element having fingers engaging the auxiliary switch leads to provide auxiliary switch signals.

8. The switch machine of claim 1 wherein the housing has a second opening and the printed circuit board extends through the second opening providing access to the electrical leads thereon.

9. The switch machine of claim 1 further comprising a linkage connecting the swing arm and switch points, the linkage including an output pin connected to the swing arm and extending through the first opening, a fulcrum connected to the exterior of the housing between the first opening and the switch points and a throw rod connected to the output pin, engaging the fulcrum and engageable with the switch points.

10. The switch machine of claim 9 wherein the position of the fulcrum is adjustable.

11. The switch machine of claim 9 wherein the throw rod is made of flexible wire.

* * * * *